United States Patent [19]

Sze

[11] 4,148,709

[45] Apr. 10, 1979

[54] HYDROLIQUEFACTION OF SUB-BITUMINOUS AND LIGNITIC COALS TO HEAVY PITCH

[75] Inventor: Morgan C. Sze, Upper Montclair, N.J.

[73] Assignee: The Lummus Company, Bloomfield, N.J.

[21] Appl. No.: 845,822

[22] Filed: Oct. 27, 1977

[51] Int. Cl.[2] ..... C10G 1/06; C10G 1/00

[52] U.S. Cl. ..... 208/10; 208/8

[58] Field of Search ..... 208/8, 10

[56] References Cited

U.S. PATENT DOCUMENTS

| | | | |
|---|---|---|---|
| 2,987,465 | 6/1961 | Johanson | 208/10 |
| 3,519,555 | 7/1970 | Keithe et al. | 208/10 |
| 3,607,719 | 9/1971 | Johnson | 208/10 |
| 3,617,474 | 11/1971 | Stotler et al. | 208/10 |
| 3,705,092 | 12/1972 | Gatsis | 208/8 |
| 3,966,585 | 6/1976 | Gray et al. | 208/131 |
| 4,028,221 | 6/1977 | Sze et al. | 208/10 |
| 4,045,187 | 8/1977 | Brink et al. | 208/8 |

*Primary Examiner*—Delbert E. Gantz
*Assistant Examiner*—William G. Wright
*Attorney, Agent, or Firm*—Marn & Jangarathis

[57] ABSTRACT

In the hydroliquefaction of a sub-bituminous and/or lignitic coal, the inlet temperature to the hydroliquefaction zone is maintained at a temperature higher than those previously employed by providing recycle of hot liquid from the outlet portion of the hydroliquefaction zone. In this manner, the hydroliquefaction is operated at higher average temperatures, and total reaction volume is reduced, thereby reducing overall costs.

9 Claims, 1 Drawing Figure

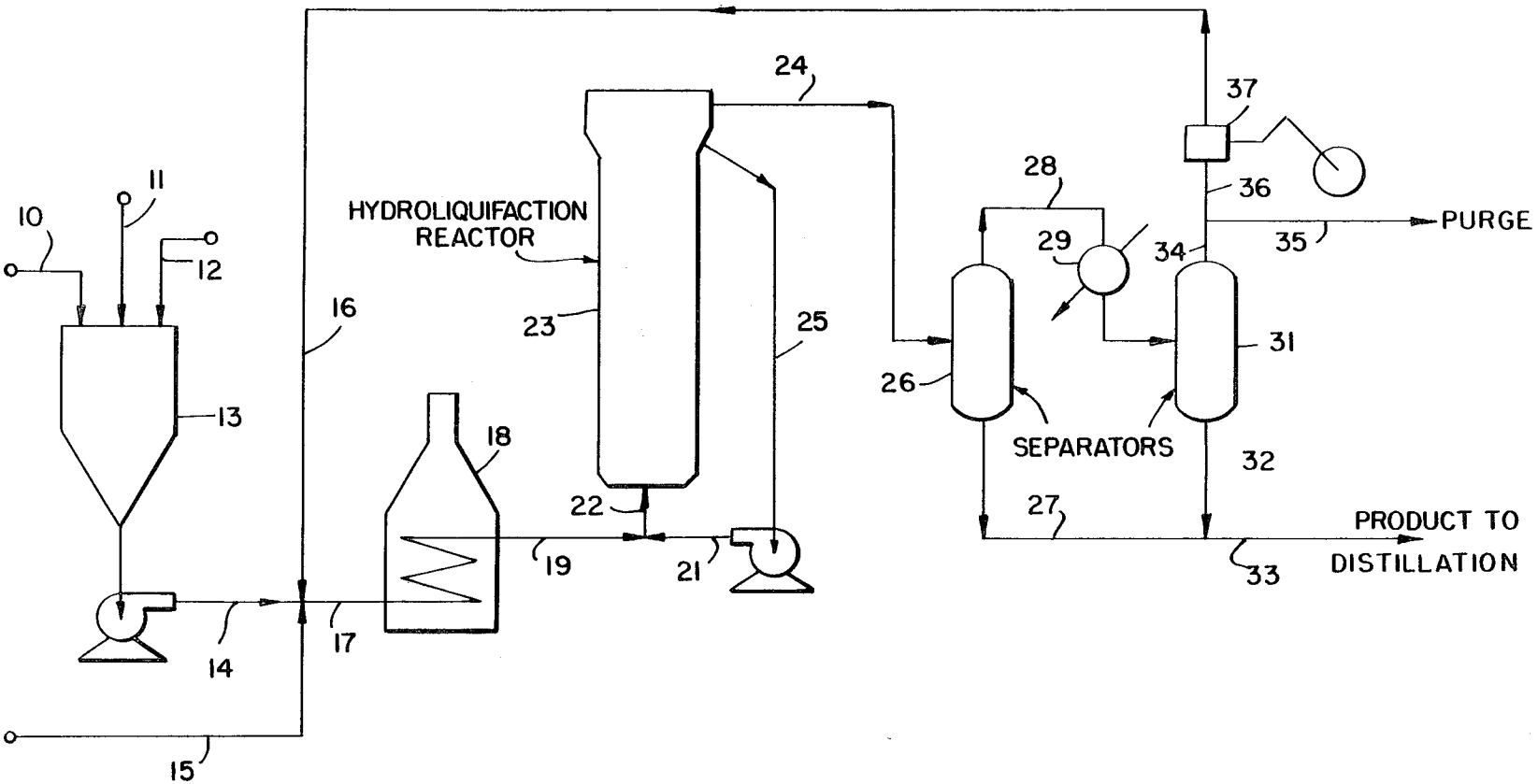
PURGE
PRODUCT TO DISTILLATION
SEPARATORS
HYDROLIQUIFACTION REACTOR
10
11
12
13
14
15
16
17
18
19
21
22
23
24
25
26
27
28
29
31
32
33
34
35
36
37

HYDROLIQUEFACTION OF SUB-BITUMINOUS AND LIGNITIC COALS TO HEAVY PITCH

This invention relates to the hydroliquefaction of coal, and more particularly, to a new and improved process for the hydroliquefaction of a sub-bituminous and/or lignitic coal to produce heavy pitch.

In accordance with prior art processes for producing heavy pitch from a lignitic coal, such as brown coal, sub-divided and dried brown coal is mixed with a pasting solvent or oil and a hydroliquefaction catalyst, such as iron oxide. The mixture together with recycle hydrogen is heated in a pre-heating furnace, and the preheated mixture introduced into the first of a series of reactors. In each reactor, the temperature is allowed to rise to the maximum allowable temperature before coking occurs, at which point the temperature is reduced by quenching with cold hydrogen. Three or four reactors are generally used in series with intermediate quenches, with the effluent from the last reactor being separated into liquid and vapor products.

The present invention is directed to improving the hydroliquefaction process for producing heavy pitch from a sub-bituminous and/or lignitic coal.

In accordance with the present invention, there is provided a process for the hydroliquefaction of a sub-bituminous and/or lignitic coal to a liquid product, containing heavy pitch, in which the hydroliquefaction feed, containing the sub-bituminous and/or lignitic coal is introduced into a hydroliquefaction zone, which is maintained at an inlet temperature higher than those employed in prior art processes, by providing recycle from the outlet portion of the hydroliquefaction zone to the inlet thereof. In this manner, the hydroliquefaction zone is operated at higher average temperatures, and total reactor volume is reduced, thereby reducing overall costs.

More particularly, the hydroliquefaction zone inlet is generally maintained at a temperature of from 725° F. to 855° F., preferably a temperature of from 775° F. to 845° F., and the outlet of the hydroliquefaction zone is generally maintained at a temperature of from 775° F. to 905° F., and preferably at a temperature of from 800° F. to 880° F. The outlet temperature is no more than 50° F. greater than the inlet temperature, with the outlet temperature generally being at a temperature of from 10° F. to 40° F. greater than the inlet temperature, and preferably at a temperature of from 15° F. to 25° F. greater than the inlet temperature.

In accordance with the present invention, the higher inlet temperatures, as hereinabove described, are maintained by providing hot recycle from the outlet portion of the hydroliquefaction zone, and such recycle is provided in an amount to maintain and control the desired inlet temperature. In general, the ratio of liquid recycle to colder fresh feed is from 3:1 to 15:1, and most generally from 5:1 to 10:1. It is to be understood, however, that such recycle ratios are illustrative, and the choice of a specific recycle ratio to maintain the desired inlet temperature, and outlet/inlet temperature difference is deemed to be within the scope of those skilled in the art. As should be apparent from the hereinabove description, it is desirable to minimize the difference between the inlet and outlet temperatures to achieve higher average temperatures. As further should be apparent, the outlet temperature is preferably maintained at a value which is below the temperature at which coking difficulties may occur.

The hydroliquefaction zone, as generally practised in the art, is operated at an elevated pressure, with the pressure generally being from 100 to 700 atms, and most generally from 125 to 300 atms.

Hydrogen is introduced into the hydroliquefaction zone in an amount, which when coordinated with the other processing conditions, provides an amount of hydrogen addition or absorption to produce a liquefied product, containing heavy binder pitch, without excessive hydrogenation. In general, hydrogen is provided in an amount of 800 to 2000 $NM^3/MT$ of ash and moisture free brown coal, preferably 900 to 1500 $NM^3/MT$ of ash and moisture free brown coal. The conditions are generally controlled to provide a hydrogen addition or absorption of 3.5 to 6.00 wt. % based on ash and moisture free brown coal and preferably in the range of 4.0 to 5.0 wt. % based on ash and moisture free brown coal. Hydrogen absorption is controlled by hydrogen partial pressure, reaction temperature and space velocity.

The desired product may be obtained from the net reactor effluent by flashing. The heavy +800° F. material should have a specific gravity of over 1.1, a softening point of 200° F., and a hydrogen content of less than 8 wt. %. A maximum of +800° F. material in the net reactor effluent is desired and generally at least 45 wt. % of the net reactor effluent consist of +800° F. material.

The sub-bituminous and/or lignitic coal introduced into the hydroliquefaction zone, as known in the art, is dispersed in a suitable pasting solvent or oil. The pasting solvent or oil, as known in the art, is preferably an indigenous solvent; i.e., derived from the coal liquefaction product; however, other pasting solvents or oils may also be employed. The selection of a particular pasting oil is well within the scope of those skilled in the art, and forms no part of the present invention; therefore, no further description in this respect is deemed necessary for a complete understanding of the present invention.

In general, as known in the art, the pasting solvent is provided in an amount to provide a pasting solvent to coal weight ratio in the order of from 1.0:1 to 3:1, and most generally from 1.2:1 to 2:1.

Similarly, as known in the art, the hydroliquefaction is effected in the presence of a suitable hydroliquefaction catalyst, and as representative examples of such catalysts, there may be mentioned: iron oxide, iron sulfide, molybdenum oxide, cobalt oxide and the like. Preferably the catalyst is in a comminuted form dispersed in the coal paste. Of course, it is also possible to use a fixed bed of catalyst. In this instance, the catalyst should be supported on larger, more uniformly sized alumina pellets. These particular catalysts form no part of the present invention, and the selection of a suitable catalyst is deemed to be within the scope of those skilled in the art; accordingly, no further details in this respect are deemed necessary for a complete understanding of the present invention.

As known in the art, sub-bituminous coals include those coals having an ASTM classification of III; and lignitic coals include those coals having an ASTM rank of IV, including also brown coal of Germany and Australia.

The invention will be further described with respect to an embodiment thereof illustrated in the accompanying drawing; however, the scope of the invention is not to be limited thereby:

The drawing is a simplified schematic flow diagram of an embodiment of the present invention.

Referring now to the drawing, a sub-bituminous and/or lignitic coal, in particular, brown coal, in line 10, a pasting solvent or oil in line 11 and a hydroliquefaction catalyst, in particular, iron oxide in line 12 are introduced into a slurry tank generally indicated as 13, in order to effect dispersal of the coal and catalyst in the pasting oil.

The mixture of coal, catalyst and pasting oil are withdrawn from the slurry tank 13 through line 14 and are admixed with make up hydrogen in line 15 and recycle gas in line 16, obtained as hereinafter described. The combined stream in line 17 is passed through a suitable heater, schematically generally indicated as 18 to heat the mixture to a temperature in the order of from about 575° F. to about 700° F., and most generally in the order of from about 600° F. to about 650° F. The pre-heating temperature is lower than those employed in prior art processes and, accordingly, there is a reduction in the amount of required heat transfer surfaces.

The pre-heated hydroliquefaction feed, including hydrogen, in line 19, is combined with recycle, in line 21, obtained as hereinafter described, to effect further heating of the feed to the inlet temperature conditions for the subsequent hydroliquefaction. The combined stream in line 22 is introduced into the bottom of a suitable hydroliquefaction reactor, schematically indicated as 23.

As hereinabove described, the inlet temperature to the hydroliquefaction reactor 23 is generally a temperature of from 725° F. to 855° F., and preferably a temperature of from 775° F. to 845° F. Such an inlet temperature is maintained by pre-mixing the feed to the hydroliquefaction reactor with the recycle from the outlet portion thereof; however, it is to be understood that such inlet temperatures could also be maintained by separately introducing the feed and the recycle to the inlet of the hydroliquefaction reactor, although such a procedure is less preferred.

The hydroliquefaction reactor 23, as particularly shown, is an upflow co-current hydroliquefaction reactor, and the coal is hydroliquefied in reactor 23 to provide the desired amount of hydrogen addition or absorption.

Net hydroliquefaction effluent is withdrawn from the outlet 24 at the top of the hydroliquefaction reactor 23. In addition, recycle is provided from the outlet portion of reactor 23 through line 25 in order to maintain and control reaction inlet temperatures.

Although the embodiment has been particularly described with respect to separate withdrawal of the net effluent and recycle, it should be apparent that there could be a single withdrawal from the top of the reactor 23, with a portion of the withdrawn liquid being recycled to the reactor inlet. In either case, the outlet of hydroliquefaction reactor 23 is maintained at the temperatures hereinabove described.

The net effluent in line 24 is introduced into a high temperature gas-liquid separator 26, with the liquid product being recovered through line 27.

The gaseous product from separator 26 is cooled in a heat exchanger 29, generally to a temperature in the order of from about 100° F. to about 120° F., and introduced into a low temperature separator 31.

The liquid product is withdrawn from separator 31 through line 32, and combined with the liquid product in line 27 to provide net liquid product in line 23, which can be passed to a suitable distillation system for recovering the various fractions.

Gas is withdrawn from separator 31 through line 34, and a portion thereof purged through line 35. The unpurged portion in line 36 is compressed by compressor 37 and recycled through line 16, as hereinabove described.

The invention will be further described with respect to the following example; however, the scope of the invention is not to be limited thereby.

EXAMPLE

A coal feed as tabulated in Table I is treated in accordance with the present invention, and in accordance with the general procedure of the prior art to produce a net product, as tabulated in Table II. The conditions employed to produce the product of Table II in accordance with the present invention and in accordance with the piror art technique are tabulated in Table III. The use of the process of the present invention, as compared to the prior art technique, requires a reactor volume which is approximately 60% of the reactor volume required by the prior art technique.

TABLE I

| DRIED BROWN COAL FEED | | |
|---|---|---|
| Constituents | Wt. % | Lbs./Ton |
| Carbon | 63.07 | 1261.40 |
| Hydrogen | 3.96 | 79.20 |
| Nitrogen | 0.5 | 10.20 |
| Sulfur (total) | 0.24 | 4.80 |
| Mineral matter (sulfur free) | 0.81 | 16.20 |
| Water | 6.02 | 120.40 |
| Organic Oxygen | 25.39 | 507.80 |
| | 100.00 | 2000.00 |
| Hydrogen Added | 4.00 | 80.00 |
| | 104.00 | 2080.00 |

TABLE II

| NET PRODUCTS | | |
|---|---|---|
| Constituents | Wt. % | Lbs./Ton |
| Ammonia ($NH_3$) | 0.218 | 4.85 |
| Water ($H_2O$) | 23.237 | 464.74 |
| Carbon Monoxide (CO) | 0.973 | 19.46 |
| Carbon Dioxide ($CO_2$) | 7.167 | 143.34 |
| Methane ($CH_4$) | 0.933 | 18.66 |
| Ethane ($C_2H_6$) | 0.373 | 7.46 |
| Propane ($C_3H_8$) | 0.423 | 8.46 |
| Butane ($C_4H_{10}$) | 0.178 | 3.56 |
| Hydrogen Sulfide ($H_2S$) | 0.065 | 1.30 |
| $C_5$-400° F. b.r. Naphtha | 2.915 | 58.30 |
| 400–550° F. b.r. Distillate | 5.955 | 119.10 |
| 500–800° F. b.r. Distillate | 6.352 | 127.04 |
| +800° F. Residual Product | 55.211 | 1104.22 |
| | 104.00 | 2080.00 |

TABLE III

| | Present Invention | Prior Art |
|---|---|---|
| Brown Coal Feed, MT/H | 1.073 | 1.073 |
| Ash & Moisture Free Brown Coal, MT/H | 1.00 | 1.00 |
| Paste Oil, MT/H | 1.50 | 1.50 |
| Paste Feed to Reactors, MT/H | 2.50 | 2.50 |
| Paste Volume, $M^3/H$ | 2.14 | 2.14 |
| Catalyst, | Finely Divided Iron Oxide | |
| Reactor Pressure, ATM. | 230 | 230 |
| Reactor Inlet Temp., ° C. | 450 | 400 |
| Reactor Outlet Temp., ° C. | 460 | 460 |
| Quench $H_2$ for Temp. Control $M^3H$ | — | 1336 |
| Reactor Liquid Recycle for Temp. Control, $M^3/H$ | 12.84 | — |

TABLE III-continued

| | Present Invention | Prior Art |
|---|---|---|
| Sp. Vel., MT/H AMF Brown Coal/$M^3$ Reactor Volume | 0.53 | 0.32 |
| Reactor Vol. Needed, $M^3$ | 1.88 | 3.12 |
| $H_2$ Consumed, Wt.% AMF coal | 4.29 | 4.29 |
| $M^3$/MT AMF Coal | 480 | 480 |

The present invention is particularly advantageous in that it is possible to convert a sub-bituminous and/or lignitic coal to a binder pitch product, without coking difficulties, with a significant savings in reactor volume plus a reduction in heat transfer surfaces required for providing heat to the system. As a result, there is a significant savings in capital cost.

The binder pitch of the present invention can be employed for use in the production of metallurgical coke. Briefly, this involves the use of a feed of a non-coking coal, some heavy binder pitch and a reduced amount of coking coal.

Numerous modifications and variations of the present invention are possible in light of the above teachings and, therefore, within the scope of the appended claims, the invention may be practiced otherwise than as particularly described.

I claim:

1. In a process for the hydroliquefaction of a hydroliquefaction feed containing a member selected from the group consisting of sub-bituminous coal and lignitic coal, the improvement comprising:

introducing hydrogen and the hydroliquefaction feed into a hydroliquefaction zone, said hydroliquefaction zone being operated at an inlet temperature of from 725° F. to 855° F.;

withdrawing a hydroliquefaction effluent from said hydroliquefaction zone, said hydroliquefaction zone being operated at an outlet temperature of from 775° F. to 905° F., said outlet temperature being no more than 50° F. greater than the inlet temperature; and providing hot recycle from the outlet portion of said hydroliquefaction zone to said inlet to heat the hydroliquefaction feed which is at a temperature of from 575°–700° F. to said inlet temperature and control and maintain said inlet temperature, whereby the outlet temperature is no more than 50° F. greater than the inlet temperature.

2. The process of claim 1 wherein the hydroliquefaction zone is operated to provide a hydrogen absorption of from 3.5 to 6.0 wt. %, based on moisture ash free coal in said hydroliquefaction feed.

3. The process of claim 2 wherein the hydroliquefaction produces a net effluent having at least 45 wt. % of 800° F.+material.

4. The process of claim 2 wherein said member is a brown coal.

5. The process of claim 1 wherein said inlet temperature is from 775° F. to 845° F. and said outlet temperature is from 800° F. to 880° F.

6. The process of claim 5 wherein the outlet temperature is from 10° F. to 40° F. greater than the inlet temperature.

7. The process of claim 6 wherein said hydroliquefaction feed is preheated to a temperature of from 575° F. to 700° F. and said recycle is mixed with said hydroliquefaction feed prior to introduction into the hydroliquefaction zone to heat said hydroliquefaction feed to said inlet temperature.

8. The process of claim 7 wherein said member is a brown coal.

9. The process of claim 8 wherein said hydroliquefaction zone is operated to provide a hydrogen absorption of from 3.5 to 6.0 wt. %, based on moisture ash free coal in said hydroliquefaction feed and provide an effluent having at least 45 wt. % of 800° F.+material.

* * * * *